US007735643B2

(12) United States Patent
Sanches et al.

(10) Patent No.: US 7,735,643 B2
(45) Date of Patent: Jun. 15, 2010

(54) INFLATABLE SHIPPING DEVICE AND METHOD OF FORMING AND USING SAME

(75) Inventors: David Sanches, 1130 Maplewood La., Champlin, MN (US) 55316; Joachim Minkwitz, Rockford, IL (US)

(73) Assignees: David Sanches, Champlin, MN (US); Daniel J. McGrail, Rockford, IL (US); Charles Stiles, Rockford, IL (US)

( * ) Notice: Subject to any disclaimer, the term of this patent is extended or adjusted under 35 U.S.C. 154(b) by 0 days.

(21) Appl. No.: 12/489,647

(22) Filed: Jun. 23, 2009

(65) Prior Publication Data

US 2009/0255841 A1 Oct. 15, 2009

Related U.S. Application Data

(63) Continuation-in-part of application No. 11/275,813, filed on Jan. 30, 2006, now abandoned, and a continuation-in-part of application No. 12/020,445, filed on Jan. 25, 2008.

(60) Provisional application No. 60/648,294, filed on Jan. 29, 2005.

(51) Int. Cl.
*A63B 55/00* (2006.01)
*B65D 81/02* (2006.01)
*B65D 30/00* (2006.01)

(52) U.S. Cl. ..... 206/315.3; 206/522; 383/3

(58) Field of Classification Search ..... 206/315.2, 206/315.8, 522, 592; 190/18 A, 115, 118; 383/3

See application file for complete search history.

(56) References Cited

U.S. PATENT DOCUMENTS

| | | | | |
|---|---|---|---|---|
| 4,044,867 | A | 8/1977 | Fisher | |
| 4,091,852 | A | 5/1978 | Jordan et al. | |
| 4,155,453 | A | 5/1979 | Ono | |
| 4,164,970 | A | 8/1979 | Jordan | |
| 4,402,355 | A | 9/1983 | Wymore et al. | |
| 4,503,558 | A | 3/1985 | Lief et al. | |
| 4,573,202 | A * | 2/1986 | Lee | 383/3 |
| 4,574,953 | A | 3/1986 | Garbuzov | |
| 4,826,329 | A | 5/1989 | Bellini | |
| 5,421,454 | A | 6/1995 | Chern | |
| 5,515,897 | A | 5/1996 | Fehan | |
| 5,624,035 | A | 4/1997 | Kim | |

(Continued)

FOREIGN PATENT DOCUMENTS

DE 2011200 U1 10/2001

(Continued)

*Primary Examiner*—Ehud Gartenberg
*Assistant Examiner*—Jose S Stephens, III
(74) *Attorney, Agent, or Firm*—Gifford, Krass, Sprinkle, Anderson & Citkowski, P.C.

(57) ABSTRACT

A lightweight assembly exhibiting a durable and puncture resistant outer material. An inflatable bladder is sandwiched between the outer material and an inner closable liner. One or more elongated articles, such a golf bag with clubs, is placed within an open interior bounded by the inner liner and, upon employing a built-in pump assembly incorporated into an attached skid plate, communicates through an inlet line to inflate the bladder in a substantially inward fashion to bias and cushion about the bag and clubs. A release valve formed at a top location of the bladder is revealed by a zippered portion in the bag, and to deflate the bladder.

10 Claims, 9 Drawing Sheets

U.S. PATENT DOCUMENTS

| | | | | |
|---|---|---|---|---|
| 5,704,475 | A | 1/1998 | Jack | |
| 5,743,363 | A * | 4/1998 | Rekuc et al. | 190/18 A |
| 5,813,527 | A | 9/1998 | Henrickson | |
| 5,890,570 | A * | 4/1999 | Sadow | 190/18 A |
| 5,921,387 | A | 7/1999 | Arzoomanian et al. | |
| 5,967,324 | A | 10/1999 | Izzo | |
| 6,182,826 | B1 * | 2/2001 | Slepian | 206/315.4 |
| 6,334,537 | B1 | 1/2002 | Tepper | |
| 6,513,658 | B1 | 2/2003 | Adkins | |
| 6,629,601 | B1 | 10/2003 | Russell | |
| 6,901,979 | B1 | 6/2005 | Herold | |
| D511,043 | S | 11/2005 | Herold | |
| 7,597,341 | B2 * | 10/2009 | Russo | 280/655.1 |
| 2001/0013519 | A1 * | 8/2001 | Liebold | 220/586 |
| 2003/0094395 | A1 | 5/2003 | Peper et al. | |
| 2004/0065569 | A1 | 4/2004 | Yang | |
| 2004/0134811 | A1 * | 7/2004 | Lai | 206/315.3 |
| 2006/0207849 | A1 | 9/2006 | Sadow | |
| 2008/0083640 | A1 | 4/2008 | Liu | |

FOREIGN PATENT DOCUMENTS

| | | | |
|---|---|---|---|
| EP | 089890 | A1 | 9/1983 |
| GB | 101041 | A | 8/1916 |
| GB | 2326102 | A | 12/1998 |

* cited by examiner

INFLATABLE SHIPPING DEVICE AND METHOD OF FORMING AND USING SAME

CROSS-REFERENCE TO RELATED APPLICATIONS

This application is a Continuation-in-part of application Ser. No. 12/020,445 filed on Jan. 25, 2008 and entitled Shipping Container and Method of Forming and Using Same, as well as of application Ser. No. 11/275,813 filed Jan. 30, 2006 and entitled Inflatable Shipping Device and Method of Forming and Using Same, which claims benefit of Provisional Patent Application Ser. No. 60/648,294, filed Jan. 28, 2005.

FIELD OF THE INVENTION

The present invention relates generally to an inflatable shipping assembly, such as used in transporting a golf bag with clubs. More specifically, the present invention discloses a lightweight assembly exhibiting a durable and puncture resistant fabric or canvas outer material, as well as a heavy duty and inflatable bladder which is contained between the outer material and an inner liner. The bag and clubs is placed within an open interior bounded by the inner liner and, upon employing a built-in pump assembly, inflates the bladder pre-positioned in a wrap around fashion in order to establish a cushion about the bags and clubs (both upwardly extending shafts and club heads). The pump can be incorporated into a skid plate secured to an external location of the outer bag material, with a release valve formed at a top location of the bladder which, upon being revealed by a zippered portion of the bag, deflates the bag.

BACKGROUND OF THE INVENTION

Inflatable devices are known in the prior art for cushioning and protecting articles contained within an inflatable cushion or body associated with the device. The objective in each instance is generally to protect the interiorly supported contents during transport or storage and prior to reuse.

One such type of device is employed for protecting golf clubs, a first example of which is disclosed in U.S. Pat. No. 5,813,527 to Henrickson, and which teaches a flexible inflatable bladder and a fabric panel, opposite lateral edges of each being joined to define a golf bag having open and closed ends. The golf bag further exhibits a bottom and sidewalls defined by the flexible bladder and a top defined by the fabric panel. Also included is a plurality of golf club dividers located at the open end of the bag.

Izzo, U.S. Pat. No. 5,967,324, teaches an inflatable collar attachable about upwardly extending golf club heads held within a bag. The collar contains a bladder which is inflatable to compress and secure the golf clubs together.

U.S. Pat. No. 5,704,475, issued to Jack, teaches a protective device for covering and protecting golf club heads in a bag and including an inflatable body portion with a tubular sleeve with a closed end and an open end for slipping over a plurality of golf clubs. A valve inflates the body portion so that an inner body portion is shaped to contour the clubs and for enveloping and resiliently securing the head and upper shaft portions of the clubs against movement.

Other inflatable articles of note include the inflatable bag of Jordan, U.S. Pat. No. 4,164,970, the carrying case with inflatable sections in Kim, U.S. Pat. No. 5,624,035, the inflatable packaging system in Peper et al., U.S. Patent Publication No. 2003/0094395, and the inflatable container in Lief et al., U.S. Pat. No. 4,503,558.

SUMMARY OF THE INVENTION

The present invention discloses a lightweight transport device for protecting elongated articles, not limited to a golf bag supporting a plurality of upwardly extending clubs. A body exhibits an elongated and three dimensional shape with a durable outer layer and an attachable inner layer. A bladder is pre-positioned against an inside of said outer layer, prior to attachment of said inner layer to sandwich the bladder between the inner and outer layers. A reclosable zipper extends along first and second aligning edges of the outer layer and between a closed top and bottom in order to reveal an open interior of the body for permitting insertion of the bag with clubs. First and second pluralities of inter-engaging and length adjustable straps extend from the outer layer and across the zipper in lengthwise spaced fashion for pre-tightening the body prior to inflation of the bladder.

A skid support is secured to an exterior side and bottom of the outer layer and incorporates a pump. A conduit extends from the pump, through the outer layer and to an inlet nipple of the bladder for inflating the bladder in a substantially inwardly displaceable fashion about the bag to prevent intermovement of the clubs and club heads, while creating a force and impact resistant cushion thereabout.

Additional features include the pump including a reciprocating handle projecting from an upper surface of the skid support. A two position latch is secured to the skid support and includes a configured upper portion restraining the handle in a first position and pivotally displaced to a second position to permit reciprocation of the handle.

The bladder further exhibits a flexible and substantially planar shape adopting a substantially sleeve shaped profile within the body. The bladder further includes an upwardly extending and folded over head incorporating a deflation valve, the outer layer exhibiting a top located zipper for accessing the deflation valve. The bladder is constructed of a durable polyurethane material with inner and outer plies sealed about their respective perimeters and further incorporating a modified lattice pattern connecting the plies and establishing a plurality of interconnected inflatable pockets.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

The present inventions disclose a device and associated method for protecting elongated items, such as a golf bag with clubs, during shipping or airline travel. As will be further described in detail, the device operates under the principle of a bladder pre-positioned between a durable and puncture resistant outer layer and an attachable inner layer.

As will also be described, a pump inflates the bladder causing it to substantially displace inwardly to protect the interiorly held items, such as notably the golf club shafts and heads from inter-movement, and while creating a cushion to deflect external impact force or pressure applied to the device. By virtue of its lightweight design, the shipping device is ideally configurable for use in protecting golf clubs, skis or other suitable articles (such as in particular wine bottles or other fragile items) during transport. In particular, airline travel places costly surcharges on weighty container devices, such as notably hard shell golf bag carriers, to which the present shipping device provides an attractive and effective lightweight alternative.

Figure 1:
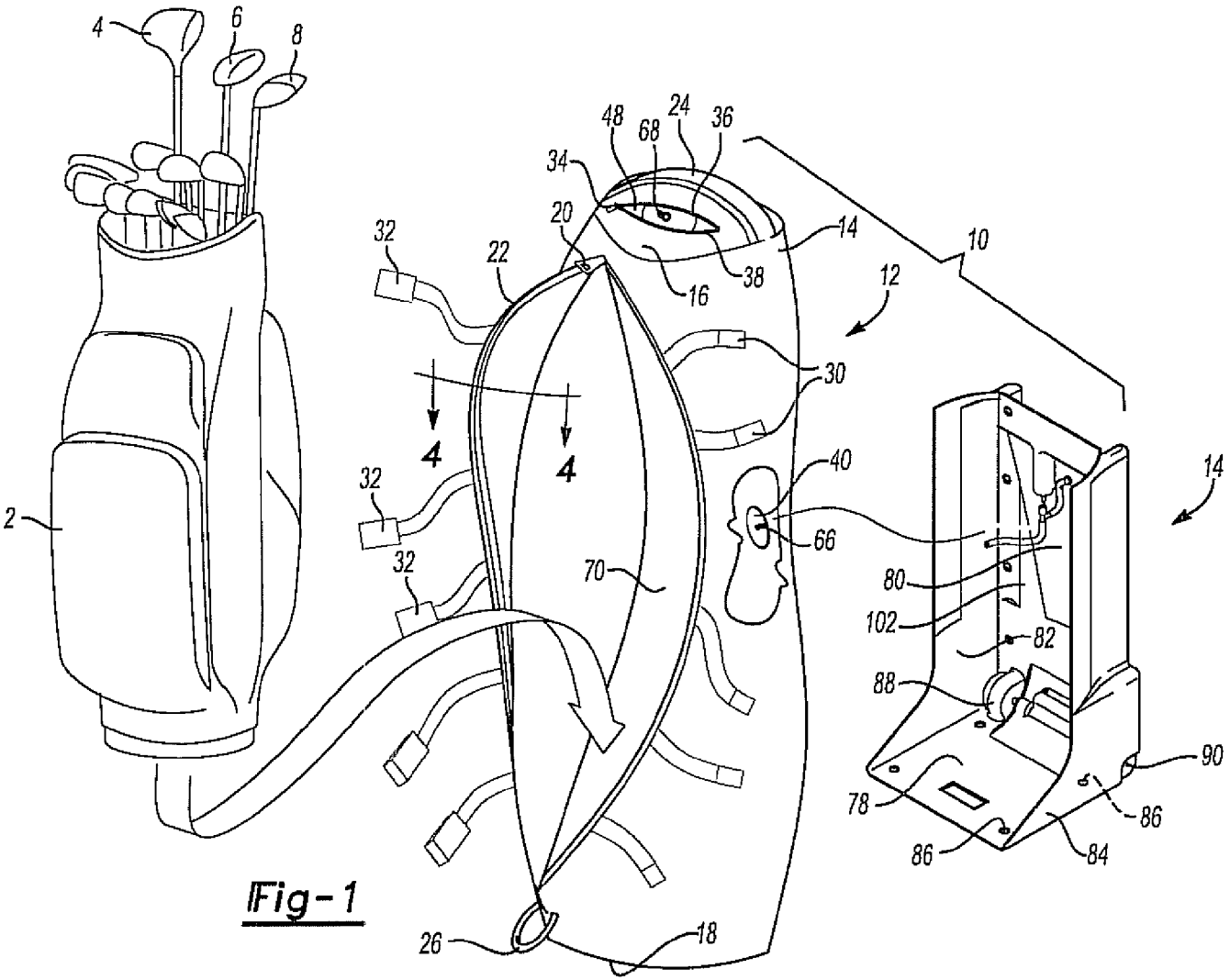
FIG. 1 is an exploded view of the inflatable shipping device including the fabric body with interior liner for receiving an interposed and inflatable bladder, as well as the secured skid plate integrating the pump sub-assembly and including an inlet line communicable with the internally held bladder for inflating the same.

Referring ton FIG. 1, an exploded view is generally shown at 10 of the shipping device and which generally includes a body 12 and a skid support (also commercially termed as a skid plate) 14. The body 12 is constructed of a durable outer layer 14 which can include a puncture resistant fabric or canvas material.

The outer layer 14 exhibits a generally elongated and three dimensional shape, e.g. generally modified tubular or cylindrical shape, exhibiting a closed top 16, a closed bottom 18, and a generally lengthwise extending (between the top 16 and bottom 18) reclosable opening which is further defined by a zipper 20 which meshingly interengages first 22 and second 24 aligning edges associated with the outer layer 14. The zipper accessible and reclosable opening is of a sufficient size to permit insertion of a golf bag 2 with plurality of clubs 4, 6, 8, et. seq. into an open interior associated with the body 12 as shown in FIG. 1.

Additional features associated with the outer layer 14 and optionally include top and bottom associated carrying handles, see as respectively shown at 26 and 28, as well as first 30 and second 32 pluralities of inter-engaging and length adjustable straps, these extending in lengthwise spaced fashion from locations of the outer layer 14 proximate and on either side of the reclosable opening. As will be further described in detail, and following insertion of the elongated articles (e.g. bag with clubs) and pre-sealing of the reclosable opening, the pluralities of lengthwise mounted straps 30 and 32 are interengaged over the reclosable opening and pre-tightened prior to inflation of the bag interior. Yet additional features associated with the outer layer 14 include a top located zipper 34 accessed opening (see also mating edges 36 and 38) and a generally read side location (generally opposite the reclosable opening) aperture 40.

Figure 5:
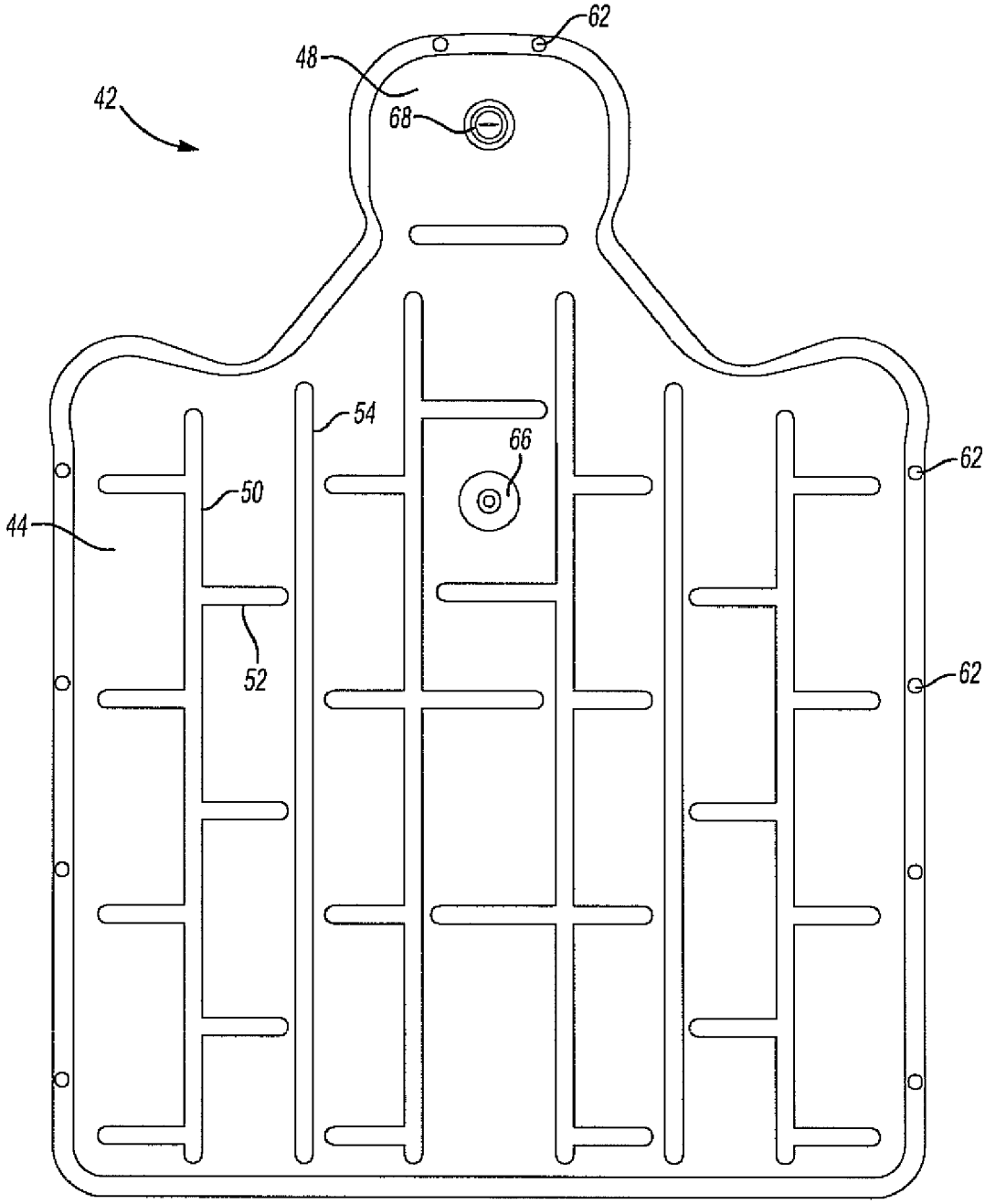
FIG. 5 is an unfurled plan view of the inflatable bladder and illustrating both the inlet nipple for communicating with the fill line extending from the pump, as well as the release valve, located in a configured head portion of the bladder, and accessible through an upper located zipper portion in the bag for deflating the bladder.
Figure 6:
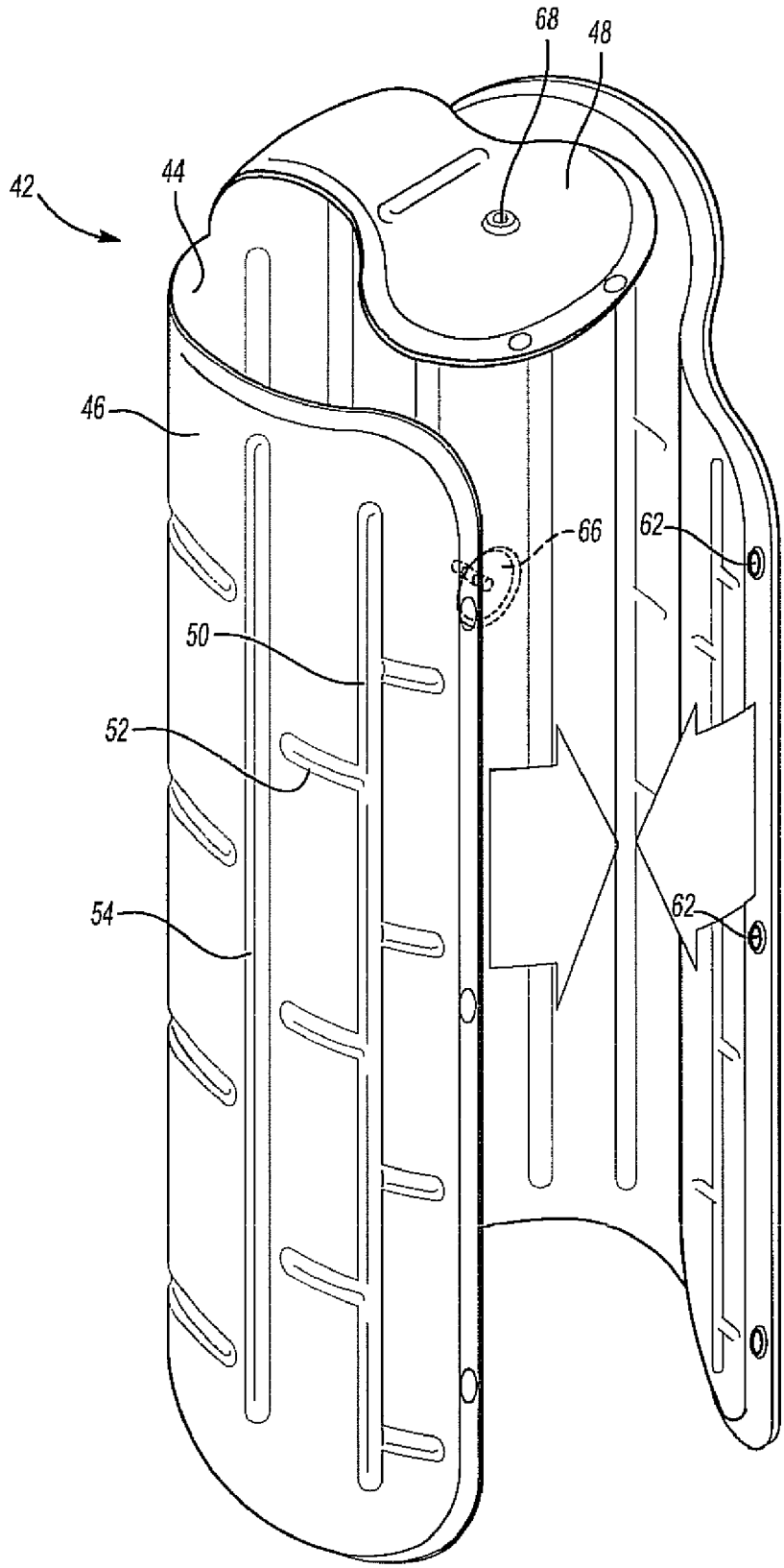
FIG. 6 is a three dimensional representation of the bladder of FIG. 5 and further showing the configuration established when the bladder is insertably fitted and snapped into place within the fabric body and sandwiched between the outer durable material and inner zippered liner.

A durable (e.g. typically heavy duty) and inflatable bladder 42 is provided (see in particular FIGS. 5 and 6. The bladder 42 is constructed of a polyurethane (or other suitable fluid impervious) material with inner 44 and outer 46 plies (see as best shown in cutaway view of FIG. 4) and which are sealed about their respective perimeters to adopt a generally planar shape (again FIG. 5) with an upwardly extending head 48. The plies of material can each exhibit a desired thickness (such as in the range of 30 mils) but are not limited to any specific thickness, shape, or material composition.

Figures 2, 3, 4:
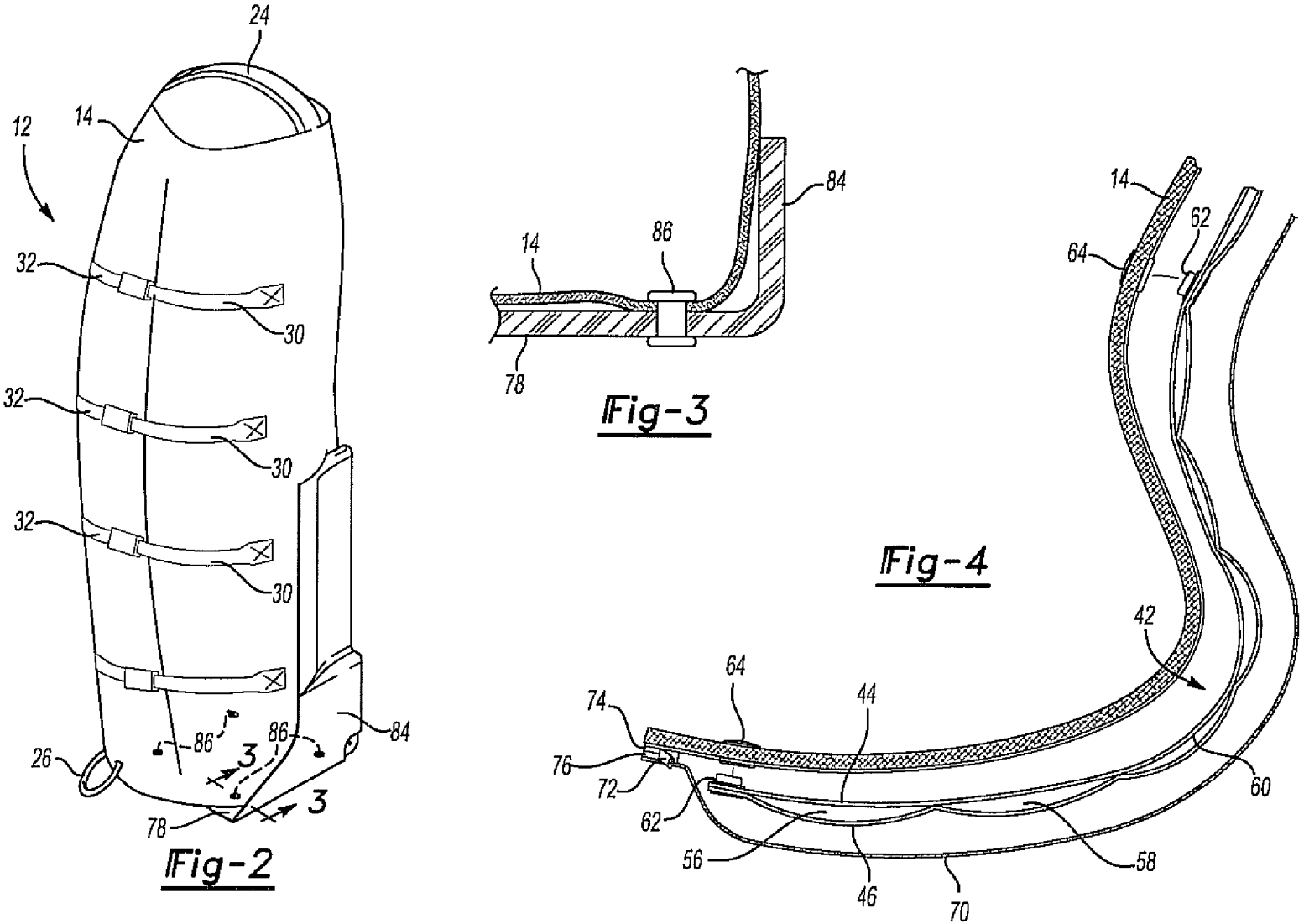
FIG. 2 is a perspective assembled view of the inflatable shipping device of FIG. 1.
FIG. 3 is a cutaway view taken along line 3-3 of FIG. 2 and showing the manner in which the rigid skid plate is secured, such as by rivets, to a location of the outer fabric body.
FIG. 4 is a cutaway view taken along line 4-4 of FIG. 1 and showing the features of the durable outer fabric body, intermediate located and snap attachable bladder, and inner zipper lining associated with the inflatable shipping device.

The bladder 42 further incorporates a modified lattice pattern (see as exemplarily shown at 50, 52, 54, et. seq. in FIG. 5), the lattices interconnecting the plies 44 and 46 of the bladder and defining a modified grid pattern for establishing a plurality of interconnected and individually defined inflatable pockets (as exemplarily shown at 56, 58, 60, et. seq. in the cutaway view of FIG. 4). The localized and fluidly interconnecting bladder pockets are dispersed along the body and head of the bladder 42.

Additional features include a plurality of perimeter defined and spaced apart snap engaging portions 62 formed along the outer perimeter of the bladder 42. An equal plurality of snap receiving portions 64 are incorporated within the outer layer 14 and situated along an inside thereof in order to receive the bladder mounted snap engaging portions 62. Alternative to the snap engaging and receiving portions, it is also envisioned that hook and loop fasteners or other releasable engaging structure can be established between the bladder 42 and the inside locations of the outer layer 14 and for supporting the bladder in the desired fashion.

In this fashion, the bladder 42 is fitted (as individually shown in FIG. 6) in a generally folded and sleeve shaped profile (see also inwardly opposing directional arrows) when secured within the inside of the outer layer 14. Other features associated with the bladder 42 include an inlet nipple 66 defined at an intermediate location in communication with the inner ply 44 (this communicating with the outer layer defined aperture 40), as well as a release/deflation valve 68 defined in the head 48 and corresponding to the exterior facing ply 46. As shown when comparing the bladder 42 in FIG. 5 with the assembly view of FIG. 1, the folded over head 48 is configured in proximity with the closed top 16 of the outer layer 14 and, upon accessing the proximately located zipper 34, reveals the release valve 68, such as which is further illustrated as a depressible button-shaped element.

An interior liner 70 (see as best shown in FIG. 4) is provided and includes a lightweight material having a specified dimension. The liner 70 is removably attached to the inside of the outer layer 14, such as through the use of additional zippers 72, (one of which being representatively shown in the cutaway of FIG. 4 association with the indicated linear extending aligning edge 22 of the outer layer 14 in FIG. 1).

Upon the bladder 42 being pre-positioned (e.g. snap engaged) against the inside of the outer layer 14, and in the manner substantially as represented in the sectional view of FIG. 6, the interior liner 70 is applied over the exposed inner layer 44 of the bladder 42 and secured, such as again by having its outer edges secured by a pair of zippers located proximate each of the outer layer aligning edges 22 and 24 and which engage mating zipper edges associated with the edges of the inner liner 70 (representatively shown at 74 and 76 in FIG. 4) as well as with proximate and lengthwise extending locations upon the inside of the outer layer 14 which are proximate to its reclosable opening and likewise overlaying the inwardly opposing and terminating sides of the bladder 42 when configured to the shape illustrated in FIG. 6. As further evident from the cutaway of FIG. 4, the inner layer 70 may further define a surface area greater than that associated with the outer layer 14 and which, as will be further discussed in detail, facilitates the ability of the inner layer 70 to bias inwardly in response to subsequent inflation of the individual defined pockets 56, 58, 60, et. seq. associated with the bladder 42. It is also envisioned and contemplated that, additional to being provided as a thin fabric, the inner layer can also be provided as a deformable, e.g. stretchable/shrinkable material and as further illustrated at 70' in each of FIGS. 9 and 10.

In this fashion, and upon loading of the device with the clubs or other elongate articles, sealing the reclosable opening and (optionally) engaging the pre-tightening straps 30 and 32, inflation of the bladder 42 causes the inner layer 70 to substantially displace inwardly to bias and immobilize the bag 2. The configuration of the bladder 42, including its upper portion and folded over interconnecting head 48, is further such that the upwardly extending shafts of the clubs, in particular the longest drivers shown at 4, 6 and 8 in FIG. 1, are likewise surrounded and biased in an immobilizing fashion, with the bladder head 48 and upper body concurrently establishing an impact force/pressure resistant cushion around the projecting club shafts and heads, thereby preventing damage to the same as an additional and separate incident to the protection afforded the bag 2. The release valve (button 68) is easily accessed through the top zipper 34 to selectively deflate some or all of the bladder pressure, such as following landing of an aircraft and removal of the inflatable shipping device from baggage.

Figure 7:
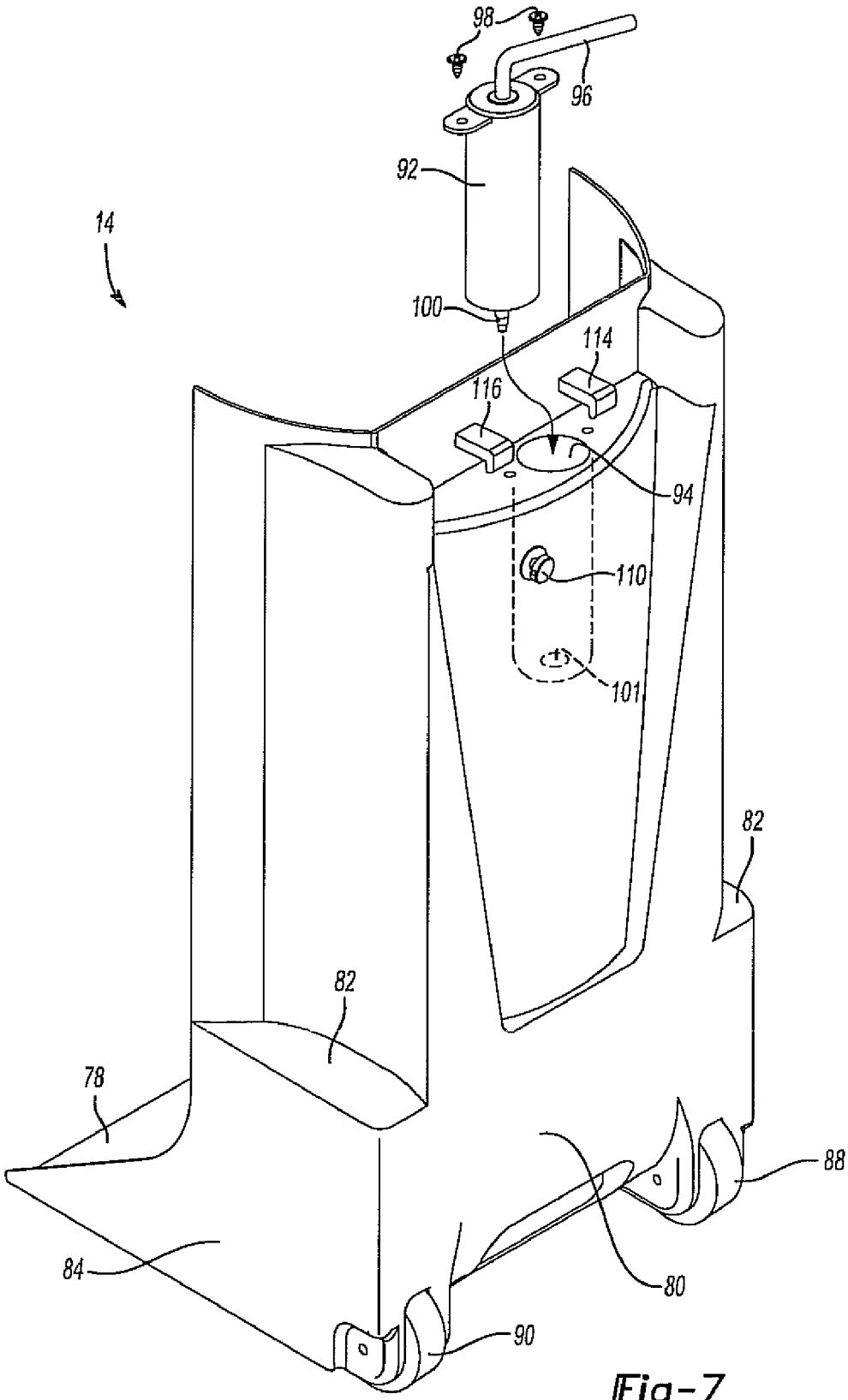
FIG. 7 is a perspective view of the skid plate and further illustrating in exploded fashion the hand pump engageable within a recess cavity associated with an exterior accessible location of the skid plate.

A skid support (also commercially termed as a skid plate) is again generally shown at 14 in FIG. 1 and is secured to an exterior side and bottom of the outer layer 14 of the shipping device body. As further shown in FIG. 7, the skid support exhibits a base 78, an interconnecting and upwardly extending side 80, and first 82 and second 84 edge extending skirts, these collectively defining the receiving configuration best shown in FIG. 1 for supporting the bottom 18 and side of the outer layer 14.

As further best shown in FIG. 3, a plurality of rivets 86 are provided for engaging the bottom and sides of the outer layer 14 to spaced apart locations along the skid support, although it is also further contemplated that other means of stitching, chemically or mechanically adhering the skid support to the outer layer are also contemplated, and further such that the skid support 14 can be either fixedly or removably attached to the outer layer of shipping device body. A pair of rollers 88 and 90 is also illustrated, located and supported along the interconnecting bottom edge boundary established between the base 78 and side 80 of the skid support and proximate each of the integrally configured side skirts 82 and 84, the rollers further providing for ease of transport of the device.

A pump 92 is provided and which is mounted within a top surface accessible recess 94 associated with the skid support 14, further such that an upwardly extending and reciprocating handle 96 can be actuated without interference from either the skid support 14 or the body of the shipping device as represented by the outer layer 14. As best shown from the partially exploded view of FIG. 7 as well as the succeeding assembled view of FIG. 8, the pump 92 in the illustrated variant can include such as a conventional bicycle or other suitably small sized and manual pump, such including both single action pumps (in which the handle pressurizes the associated cylinder only during a down stroke action) as well as a two way pump configuration (and further in which the handle pressurized the pump cylinder during each of successive down stroke and return stroke actions and in order to more efficiently pressurize and inflate the bladder 42.

A pair of mounting screws 98 is provided for securing the pump 92 within the skid support recess 94. A downwardly extending outlet nipple 100 of the pump 92 communicates through an aperture 101 (shown in FIG. 7 but cutaway in FIG. 8) defined at an angularly configured surface associated with the side 80 of the skid support and is connected to by a first end of a conduit 102, an opposite end of which (at 104 in FIG. 8) engages the inlet nipple 66 associated with the bladder 42 and through the outer layer located aperture 40.

An optional pressure relief line is shown at 106 (again FIG. 8) and includes a first end extending from an intermediate nipple connection 108 associated with the pump outlet conduit 102. The relief line 106 communicates at an opposite end with a button shaped element 110, the same being internally channeled to communicate a pressure overflow with a bleed aperture 112 (again FIG. 8).

The purpose of the pressure relief line 106 is to prevent inadvertent over-inflating of and damage to the bladder 42 from excessive manipulation of the pump handle portion 96. That said, it is also envisioned that the pressure relief line 106 can be deleted from the assembly without substantial impairment to its functionality, and further such that appropriate over-pressure relief can be incorporated directly into the main outlet conduit 106, such as further through the provision of an intermediately interposed check valve or the like.

Figure 8:
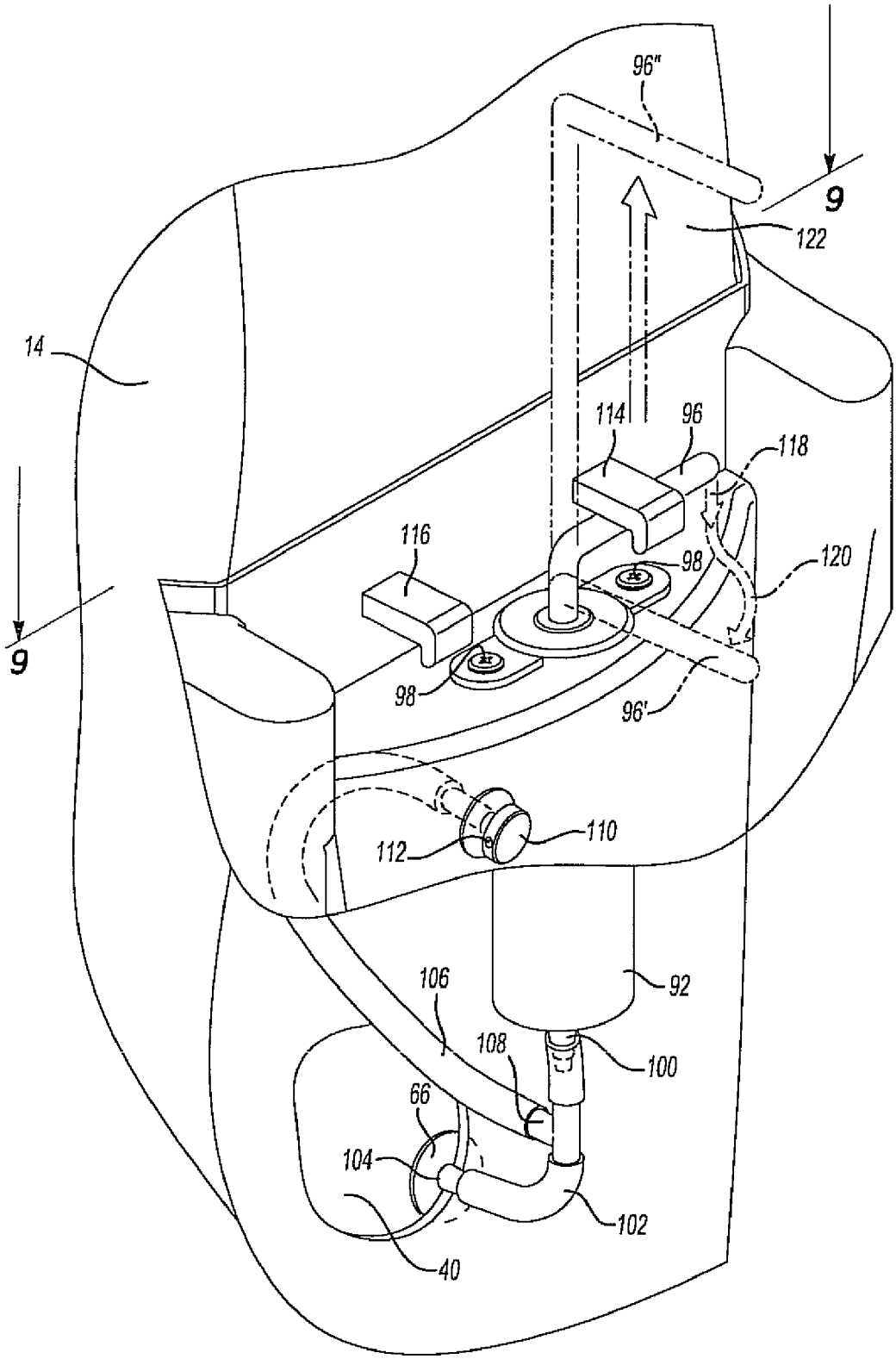
FIG. 8 is an enlarged sectional view of the skid plate in FIG. 7 and illustrating the manner in which the upwardly extending pump handle is secured in a first storage position and rotated for reciprocating in a second position, as well as showing the provision of the inlet line extending from a lowermost located outlet nipple to the inlet nipple associated with the inflatable bladder, and in addition to illustrating an optional separate pressure release line extending from an intermediate location of the inlet line and terminating in a release button mounted to a location of the skid plate.

Whether or not a separate pressure relief line is employed, and in order to guard against inadvertent overfill of the bladder 42 resulting from continual reciprocation of the pump handle 96 (such as which can occur without human intervention and depending upon the transport circumstances) an additional feature includes the provision of one or more handle restraining catch portions, these being shown at 114 and 116 in each of FIGS. 7-10. As best shown in FIG. 8, the handle 96 is disengaged from its selected catch portion 114 by initially depressing downwardly (see arrow 118) and subsequently rotated (via arrow 120) to a generally perpendicular facing direction relative to the skid support. The handle is thus reconfigured to a use position 96', whereby an initial extending linear motion (arrow 122) causes the handle to extend to an uppermost position 96", the handle subsequently being reciprocated up and down a selected number of iterations to fill the interiorly supported bladder 42 and prior to the handle being reseated with a selected catch portion 114 or 116.

Figure 11:
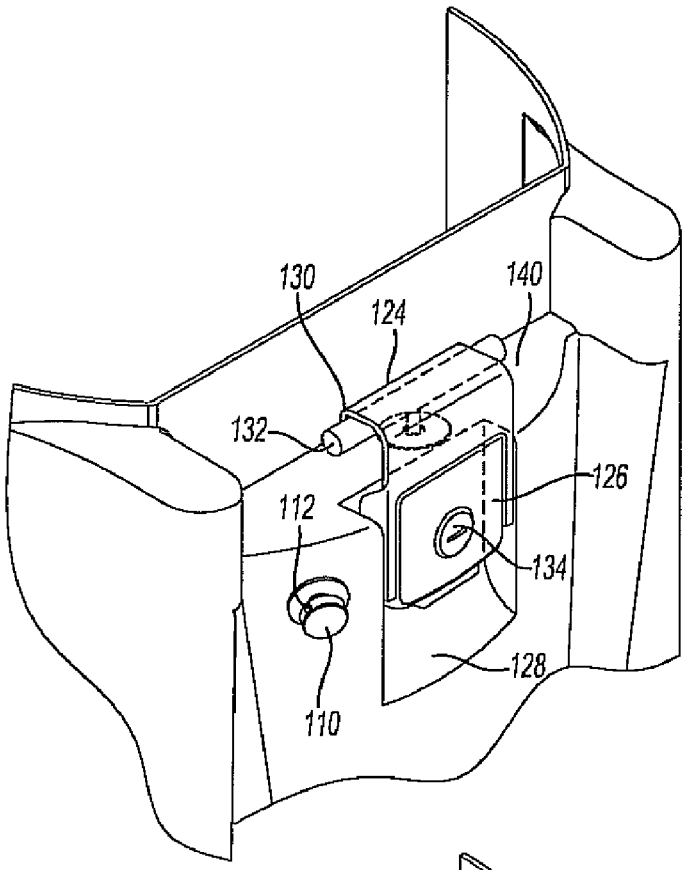
FIG. 11 a partial cutaway view of a skid plate with built in pump sub-assembly according to a further proposed variant of the present inventions and illustrating a latch with upwardly configured handle for restraining against actuation of the pump handle.
Figure 12:
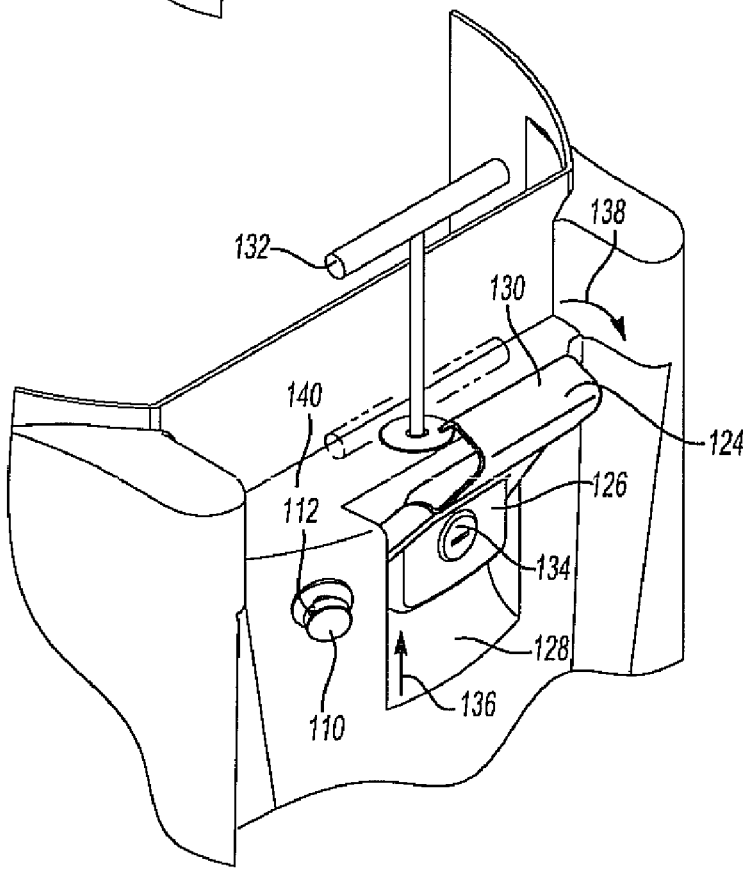
FIG. 12 is a succeeding view illustrating a release position of the latch and permitting up/down reciprocating actuation of the handle in a bladder-inflating step.

Referring further to each of FIGS. 11 and 12, partial cutaway views are shown of a skid plate with built in pump sub-assembly according to a further proposed variant and illustrating a latch sub-assembly with upwardly configured portion 124 for restraining against actuation of the pump handle. In particular, a two position latch includes a base portion 126 which is both linearly displaceably along and pivotally secured to the skid support within an exposed recess location 128 thereof. The upwardly configured portion 124 is pivotally inter-engaged with the base portion 126, a top edge of which is configured to curl downwardly (see at 130) in order to be operable in a first locked position to engage an upper most and horizontal portion (at 132) of an upwardly projecting handle, preventing manipulation of the same.

Upon actuating a key accessible lock, illustrated at 134 in association with the base portion 126 and further understood to include a hidden locking tab for preventing actuation of the base portion 126 in a first position), the lock 134 is subsequently rotated to a second position in which the base portion 126 can be grasped (such as along a bottom surface) and subsequently displaced upwardly (see arrow 136 in FIG. 12). The base portion 126 can also be pivoted outwardly (not shown) relative to the recess configured surface of the skid support and which, as further dictated by the nature of its construction, causes the upwardly configured portion 124 to pivot outwardly (see arrow 138) away from the handle 132, thereby allowing the same to be reciprocated without interference by either the latch sub-assembly or the surface of the skid support.

Regardless of the embodiment, it is also envisioned and understood that the handle portion of the pump can be redesigned to ergonomically contour (not shown) with an upper facing ledge 140 (see FIGS. 11 and 12) associated with the skid support. In this instance, one or more finger access recesses or the like can be established between the outer adjoining surfaces of the ledge 140 and the exterior profile of such an ergonomically configured handle in order to render ease of access.

Figure 9:
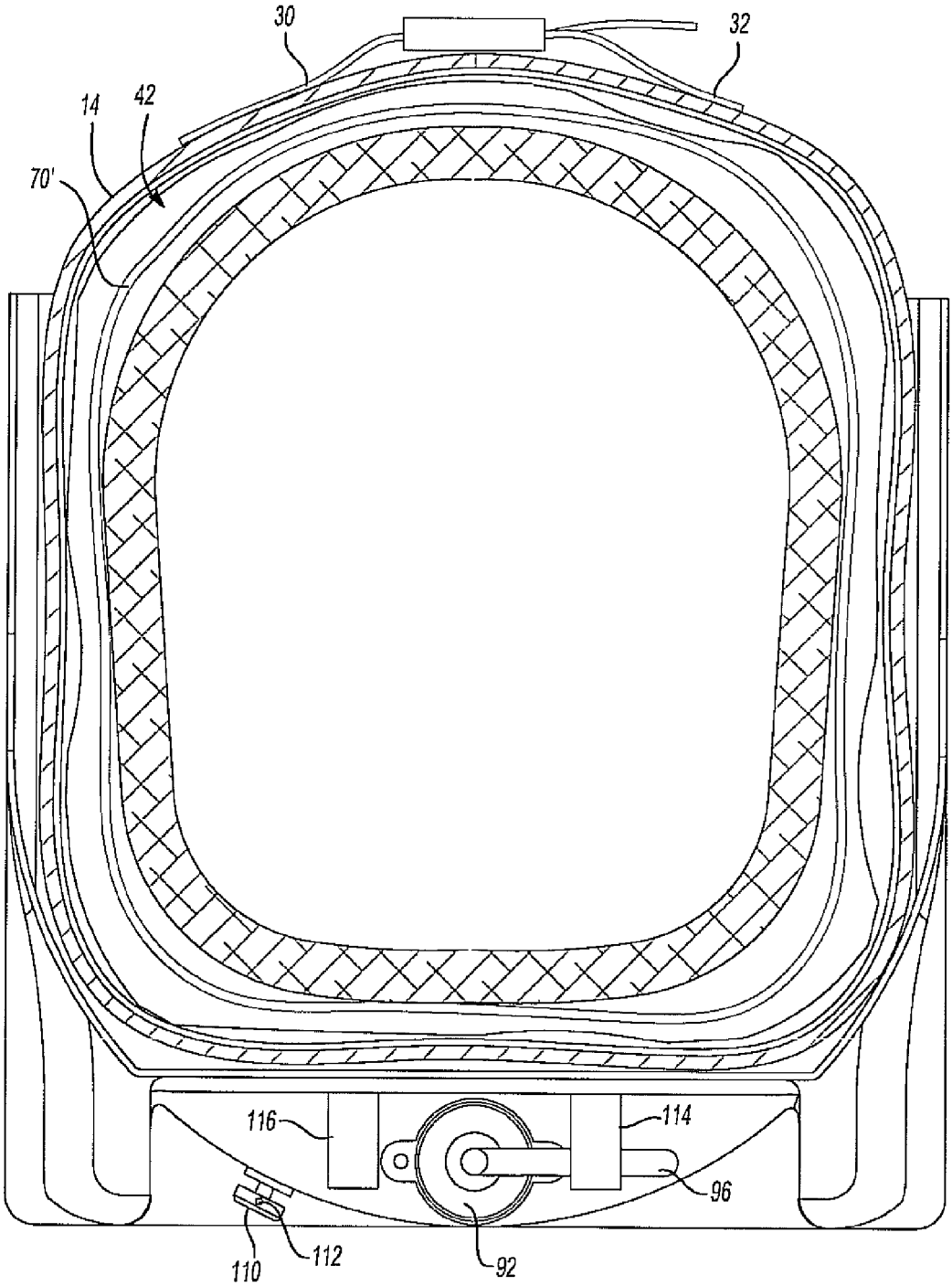
FIG. 9 is a cutaway view taken along line 8-8 of FIG. 8 and further illustrating the fabric body with installed bladder in a first un-inflated condition, corresponding to the pump handle in the storage position shown in solid in FIG. 8, and associated with an interiorly supported golf bag.
Figure 10:
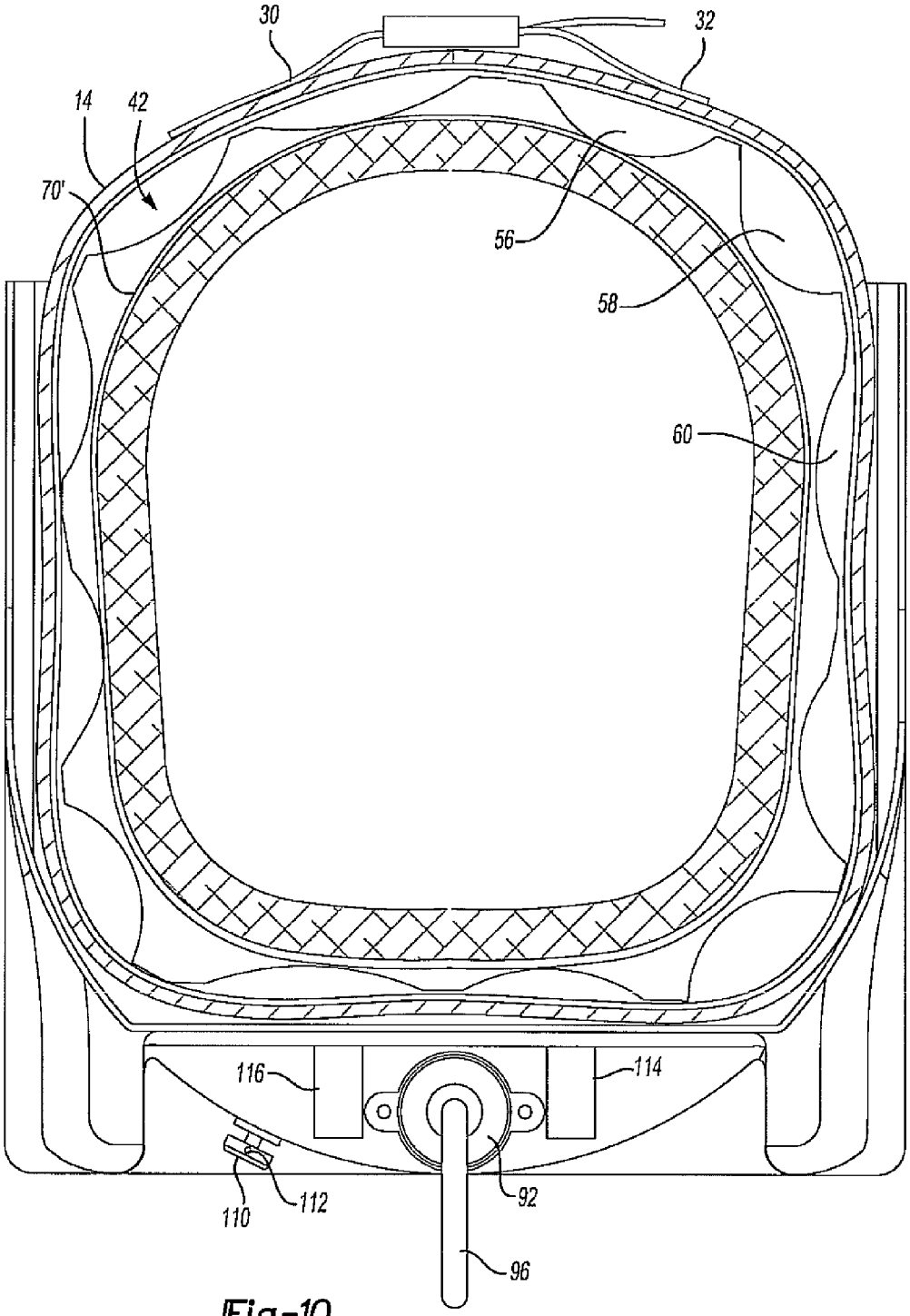
FIG. 10 is a succeeding illustration illustrating the bladder in a substantially inflated condition whereby it biases against the exterior walls of the golf bag.

Reiterating the previous description surrounding the inflation of the bladder 42 and resultant inward biasing action of the inner layer 70, from the pre-inflated position of the cutaway in FIG. 9, to the post inflation position further referenced in FIG. 10, it is evident that the present invention provides a novel and improved lightweight device for protecting any type of article, including both elongated articles (skis, clubs, etc.) as well as other fragile articles for which the device is suitably configured for use. Other contemplated features include providing the outer body as any of a flexible, semi-flexible and semi-rigid construction, thereby modulating the degree of inwardly biasing/compression applied by the bladder inducted inner layer and in order to establish the desired immobilization of the interiorly held articles, while at the same time establishing the desired protective cushion thereabout.

Having described my invention, other and additional preferred embodiments will become apparent to those skilled in the art to which it pertains, and without deviating from the scope of the appended claims.

We claim:

1. A device for protecting elongated articles such as during transport, comprising:

a flexible body exhibiting an elongated and three dimensional shape having a durable outer layer and an attachable inner layer, a reclosable opening revealing an open interior of the body for permitting insertion of the elongated articles;

a bladder pre-positioned against an inside of said outer layer, prior to attachment of said inner layer to sandwich said bladder between said inner and outer layers;

a pump inflating said bladder in a substantially inwards fashion to prevent inter-movement of the articles while creating a force and impact resistant cushion thereabout; a skid support secured to an exterior side and bottom of said outer layer and incorporating said pump; a conduit extending from said pump, through said outer layer and to an inlet nipple of said bladder; a pressure relief line extending from said conduit and communicating with a button secured to an exterior surface of said skid support; and said skid support further comprising a base, an interconnecting and upwardly extending side and first and second edge extending skirts collectively supporting a pair of spaced apart rollers, a plurality of rivets engaging said outer layer to spaced apart locations along said skid support.

2. The device as described in claim 1, said pump further comprising a reciprocating handle projecting from an upper surface of said skid support.

3. The device as described in claim 2, further comprising a two position latch secured to said skid support and including a configured upper portion restraining said handle in a first position and pivotally displaced to a second position to permit reciprocation of said handle.

4. The device as described in claim 1, said bladder further comprising a flexible and substantially planar shape adopting a substantially sleeve shaped profile within said flexible body, said bladder further including an upwardly extending and folded over head incorporating a deflation valve.

5. The device as described in claim 4, said outer layer further comprising a top located zipper for accessing said deflation valve.

6. The device as described in claim 4, said bladder further comprising a plurality of perimeter defined and spaced apart snap engaging portions, an equal plurality of snap receiving portions located along said inside of said outer layer.

7. The device as described in claim 4, said bladder being constructed of a durable polyurethane material with inner and outer plies sealed about their respective perimeters and further incorporating a modified lattice pattern connecting said plies and establishing a plurality of interconnected inflatable pockets.

8. The device as described in claim 1, said durable outer layer further comprising at least one of a puncture resistant nylon or canvas material defining an inner surface area, said inner layer exhibiting a lightweight material attached by a zipper about its perimeter to said outer layer and defining a surface area greater than said outer layer to permit said inner layer to inwardly bias against the articles upon inward inflation of said bladder.

9. The device as described in claim 1, said reclosable opening further comprising a zipper extending lengthwise along first and second aligning edges of said outer layer and between a closed top and bottom.

10. The device as described in claim 9, further comprising first and second pluralities of inter-engaging and length adjustable straps extending from said outer layer and across said zipper in lengthwise spaced fashion for pre-tightening said flexible body prior to inflation of said bladder.

* * * * *